US010954663B2

(12) United States Patent
Mou et al.

(10) Patent No.: US 10,954,663 B2
(45) Date of Patent: Mar. 23, 2021

(54) CYLINDRICAL SLEEVE-TYPE STEEL-WOOD COMPOSITE JOINT AND THE ASSEMBLY METHOD

(71) Applicant: QINGDAO UNIVERSITY OF TECHNOLOGY, Qingdao (CN)

(72) Inventors: Ben Mou, Qingdao (CN); Wanqiu Zhou, Qingdao (CN); Peng Feng, Qingdao (CN); Bingcheng Yan, Qingdao (CN)

(73) Assignee: QINGDAO UNIVERSITY OF TECHNOLOGY, Qingdao (CN)

( * ) Notice: Subject to any disclaimer, the term of this patent is extended or adjusted under 35 U.S.C. 154(b) by 0 days.

(21) Appl. No.: 16/977,108

(22) PCT Filed: Sep. 30, 2019

(86) PCT No.: PCT/CN2019/109295
§ 371 (c)(1),
(2) Date: Sep. 1, 2020

(65) Prior Publication Data

US 2021/0025159 A1 Jan. 28, 2021

(30) Foreign Application Priority Data

Jul. 24, 2019 (CN) ..... 201910669607.1

(51) Int. Cl.
*E04B 1/26* (2006.01)
*E04B 1/58* (2006.01)

(52) U.S. Cl.
CPC ..... *E04B 1/2604* (2013.01); *E04B 1/58* (2013.01); *E04B 2001/266* (2013.01); *E04B 2001/2644* (2013.01); *E04B 2001/2652* (2013.01)

(58) Field of Classification Search
CPC ..... E04H 12/22; E04H 12/2292; E04C 3/12; E04C 3/22; E04C 3/292; E04C 3/30;
(Continued)

(56) References Cited

U.S. PATENT DOCUMENTS 3,203,150 A * 8/1965 Serneblad ..... E04B 1/2403 52/664
4,014,089 A * 3/1977 Sato ..... E04B 1/2403 29/525.11

(Continued)

FOREIGN PATENT DOCUMENTS

CN 205116401 U 3/2016
CN 208668636 U 3/2019

(Continued)

*Primary Examiner* — Jessica L Laux
(74) *Attorney, Agent, or Firm* — Bayramoglu Law Offices LLC

(57) ABSTRACT

A cylindrical sleeve-type steel-wood composite joint includes fiberglass reinforced panel (FRP) cylindrical wood columns, X-shaped wood beams, a key connecting component, arc connecting pieces and splicing outer ring plates. The key connecting component consists of upper and lower cylindrical steel sleeve plates, a connecting sleeve, a cylindrical solid wood and filling wood blocks. The FRP cylindrical wood columns are connected to the key connecting component and are inserted into the key connecting component through the cylindrical steel sleeve plates and penetrative steel bars. The X-shaped wood beams are connected to the key connecting component through the arc connecting pieces, and the splicing outer ring plates are fixed with bolts to realize combination and connection. By adoption of the design of the connecting sleeve, the joint has a high bearing capacity, vertical force transfer is guaranteed, operation is easy, and assembly is fast.

12 Claims, 16 Drawing Sheets

(58) Field of Classification Search
CPC ..... E04C 3/32; E04C 3/36; E04B 2001/262; E04B 2001/2644; E04B 2001/2648; E04B 2001/2652; E04B 2001/2636; E04B 2001/2676; E04B 2001/2692; E04B 2001/266
See application file for complete search history.

(56) References Cited

U.S. PATENT DOCUMENTS 4,863,305 A * 9/1989 Schold ..... E04B 1/2604 403/171
5,285,614 A * 2/1994 Fouad ..... E04H 12/2276 403/311
5,285,616 A * 2/1994 Tripp ..... B29B 17/0042 52/837
5,326,410 A * 7/1994 Boyles ..... B29C 66/1142 156/71
5,586,838 A * 12/1996 Walsh ..... B29C 53/582 156/187
5,680,737 A * 10/1997 Sheipline ..... E04B 1/24 403/169
5,896,723 A * 4/1999 Sing ..... B27B 1/00 52/233
5,901,525 A * 5/1999 Doeringer ..... E04H 12/2253 248/519
6,022,165 A * 2/2000 Lin ..... E04B 1/2608 403/170
6,073,405 A * 6/2000 Kasai ..... E04B 1/2403 403/270
6,138,427 A * 10/2000 Houghton ..... E04B 1/2403 52/236.3
6,219,989 B1 * 4/2001 Tumura ..... E04B 1/2403 52/274
7,310,920 B2 * 12/2007 Hovey, Jr. ..... E04B 1/24 52/282.1
7,637,076 B2 * 12/2009 Vaughn ..... E04B 1/24 52/838
7,703,244 B2 * 4/2010 Suzuki ..... E04B 1/24 52/167.3
8,734,058 B1 * 5/2014 Schmidt ..... E02D 5/64 405/255
8,915,042 B2 * 12/2014 Ahn ..... E04B 1/24 52/649.6
10,179,991 B2 * 1/2019 Houghton ..... E04B 1/2403
2006/0144006 A1 * 7/2006 Suzuki ..... E04H 9/024 52/655.1
2006/0265992 A1 * 11/2006 Hiragaki ..... E04B 5/43 52/633
2007/0209314 A1 * 9/2007 Vaughn ..... F16B 9/01 52/838
2009/0321596 A1 * 12/2009 Ehrhardt ..... E02D 27/42 248/219.4

FOREIGN PATENT DOCUMENTS

CN 109667350 A 4/2019
JP H09291605 A 11/1997

* cited by examiner

CYLINDRICAL SLEEVE-TYPE STEEL-WOOD COMPOSITE JOINT AND THE ASSEMBLY METHOD

CROSS REFERENCE TO THE RELATED APPLICATIONS

This application is the national stage entry of International Application No. PCT/CN2019/109295, filed on Sep. 30, 2019, which is based upon and claims priority to Chinese Patent Application No. 201910669607.1, filed on Jul. 24, 2019, the entire contents of which are incorporated herein by reference.

TECHNICAL FIELD

The invention belongs to the field of wood building joint design, and particularly relates to a cylindrical sleeve-type steel-wood composite joint formed by connecting cylindrical wood columns and X-shaped wood beams, and an assembly method thereof.

BACKGROUND

In the field of modern buildings focusing on environmental friendliness, wood-structured buildings, as low-energy-consumption, light and environmentally-friendly buildings, have great application potentials and high research value. Wood structures featured by short construction period, energy conservation, environmental friendliness, and good seismic resistance and energy-dissipating capacity have the advantages of flexible configuration, sound insulation and shock attenuation in design.

The joints of the wood-structured buildings are one of the most important regions of the entire structure. The column-beam force-transfer intersections of traditional pure-wood joints are prone to destructive losses. Most existing joints are pure-steel joints that realize connection by inserting steel sheets into wood. However, the pure-steel joints are prone to stress concentration, and cracks may be caused along the texture in the opening direction. In addition, to guarantee essential force transfer of beams, the force-transfer section of vertical columns is often weakened, which results in poor integrity and poor stress performance; and the seismic performance of the vertical columns is superior to that of other portions.

SUMMARY

The invention provides a novel cylindrical sleeve-type steel-wood composite joint, which innovatively designs the connection between fiberglass reinforced panel (FRP) cylindrical wood columns and X-shaped wood beams to enhance the force-transfer capacity of vertical columns and avoid adverse influences of force transfer of the beams on force transfer of the columns, and is easy to assemble and operate.

The invention is implemented through the following technical solution: a cylindrical sleeve-type steel-wood composite joint comprises FRP cylindrical wood columns and X-shaped wood beams, and further comprises a key connecting component, arc connecting pieces and splicing outer ring plates, wherein the FRP cylindrical wood columns are connected through the key connecting component, the X-shaped wood beams are connected to the key connecting component through the arc connecting pieces, the splicing outer ring plates are arranged at upper and lower ends of the arc connecting pieces, and the splicing outer ring plates are fixed with bolts to realize combination and connection;

The key connecting component comprises cylindrical steel sleeve plates, a connecting sleeve, a cylindrical solid wood and filling wood blocks, wherein the cylindrical solid wood is arranged in the connecting sleeve, the connecting sleeve is made of steel, steel bar holes allowing penetrative steel bars to be inserted therein are formed in the cylindrical steel sleeve plates, the penetrative steel bars penetrate through the corresponding steel bar holes in the cylindrical steel sleeve plates to integrally connect the FRP cylindrical wood columns in an axial direction, and corresponding steel bar holes are formed in the FRP cylindrical wood columns; the cylindrical steel sleeve plates are arranged at upper and lower ends of the connecting sleeve, the inner diameter of the cylindrical steel sleeve plates is equal to the outer diameter of the FRP cylindrical wood columns, and the filling wood blocks encircle the connecting sleeve, are arranged between the upper and lower cylindrical steel sleeve plates and are fixed with glue;

Each arc connecting piece comprises a perforated arc base plate and two perforated arc steel plates, wherein the two perforated arc steel plates are arranged on the perforated arc base plate backing onto each other, and a space formed between the two perforated arc steel plates fits the X-shaped wood beams in shape; the arc connecting pieces are arranged around the outer circumference of the key connecting component, each perforated arc base plate is fixed on two adjacent filling wood blocks with wood screws, and the perforated steel plates are used to tighten the X-shaped wood beams. Eight screw holes are formed in each perforated arc base plate and correspond to four wood screw holes formed in each side of each filling wood block of the key connecting component, the wood screws penetrate through the perforated arc base plates to be screwed into the wood screw holes, and each arc connecting piece is fixed on two adjacent filling wood blocks. The distance between the two perforated arc steel plates is slightly greater than the thickness of webs of the X-shaped wood beams, four vertical bolt holes and two horizontal bolt holes are formed in each perforated arc steel plate, and the webs of the X-shaped wood beams are inserted between the perforated arc steel plates. Horizontal bolts penetrate through one arc steel plates, the webs of the X-shaped wood beams and the other arc steel plates and are then tightened with nuts, and vertical bolts penetrate through the splicing outer ring plates, flanges of the X-shaped wood beams and the arc steel plates and are then tightened with nuts.

Each splicing outer ring plate comprises a base plate and an arc hoop arranged on one side of the base plate, wherein bolt holes are formed in the surface of the base plate, and connecting clamps are also arranged on the base plate. The adjacent splicing outer ring plates are connected through the connecting clamps; and after being connected, the adjacent splicing outer ring plates externally hoop a middle part of the key connecting component to clamp the filling wood blocks and are integrally connected to the arc connecting pieces and the X-shaped wood beams through bolts to transfer internal force of the beams.

Furthermore, each FRP cylindrical wood column comprises a cylindrical wood column body and an FRP fabric arranged on the outer surface of the cylindrical wood column body. The FRP fabric wound on the outer surface of the cylindrical wood column body enhances the structural strength of the cylindrical wood column body.

Furthermore, arc splicing heads are arranged at upper and lower ends of the connecting sleeve, and connecting slots matched with the arc splicing heads are arranged on the cylindrical steel sleeve plates. The arc splicing heads are clamped in the connecting slots to connect the cylindrical steel sleeve plates and the connecting sleeve.

Furthermore, straight slots matched with the penetrative steel bars and notches matched with the arc splicing heads are formed in the filling wood blocks to realize tight fit of the filling wood blocks and the cylindrical steel sleeve plates.

Furthermore, a 45° angle is formed between each connecting clamp and the plane where the base plate is located to ensure that force is still transferred along the centroid line.

Furthermore, split bolts for tensioning the penetrative steel bars are further arranged on the cylindrical steel sleeve plates to apply a pre-stressing force to enhance the integrity and improve the overall performance of the key connecting components.

The invention further provides an assembly method of the cylindrical sleeve-type steel-wood composite joint, which comprises the following steps:

A. Disposing the cylindrical steel sleeve plates around the FRP cylindrical wood columns injected with glue, arranging the split bolts on the penetrative steel bars, and screwing the arc splicing heads of the connecting sleeve, internally provided with the cylindrical solid wood, into the connecting slots in corresponding sides of the cylindrical steel sleeve plates;

B. Fixing the connecting sleeve between the cylindrical steel sleeve plates, inserting four filling wood blocks, and bonding the filling wood blocks into a whole with glue;

C. Assembling the four arc connecting pieces at corresponding positions of the filling wood blocks with wood screws, fixing each arc connecting piece on two adjacent filling wood blocks, and connecting the four arc connecting pieces to form a sleeve around the key connecting component;

D. Assembling the splicing outer ring plates close to the arc connecting pieces, and connecting the splicing outer ring plates into a hoop to clamp the filling wood blocks;

E. Tightening the split bolts on the penetrative steel bars, and applying an appropriate pre-stressing force to realize tight connection of the key connecting component to enhance the integrity of the key connecting component;

F. Inserting the FRP cylindrical wood columns into the sleeve on corresponding sides of the cylindrical steel sleeve plates, and injecting glue into the steel bar holes to complete installation of the FRP cylindrical wood columns in the vertical direction and the key connecting component; and G. Inserting one end of each X-shaped wood beam between the two perforated arc steel plates of each arc connecting piece, inserting bolts for connection, and connecting the arc connecting pieces, the X-shaped beams and the splicing outer ring plates into a whole through the bolts to complete installation of the beams in the horizontal direction, so that assembly of the cylindrical sleeve-type steel-wood composite joint is finished.

Compared with the prior art, the invention has the following advantages and beneficial effects:

The entire cylindrical sleeve-type steel-wood composite joint provided by the invention is of a fully-spliced structure, the solid-wood connecting sleeve is connected to the cylindrical steel sleeve plates through slots in the core connection region, the filling wood blocks are filled in the connection region for glue connection, the split bolts are arranged on the penetrative steel bars, the design of the connecting sleeve can effectively guarantee the vertical bearing capacity of the joint, and the pre-stressing force applied by means of the split bolts can effectively improve the anti-seismic capacity of the structure; a horizontal load is borne by the splicing outer ring plates, and a vertical load is borne by the key connecting component, so that the bearing capacity is high, vertical force transfer is guaranteed, and mutual interference of horizontal force transfer and vertical force transfer is avoided.

Fully-prefabricated construction and assembly are realized on site, and only bolted connection and glue bonding are performed, so that operation is easy, assembly is fast, the quality is high, the design requirements of wood-structured buildings with special vertical bearing requirements can be met, and the composite joint can be applied to wood structures with extremely high requirements for the vertical bearing capacity and strength and has great market potentials in high-rise wood buildings.

DETAILED DESCRIPTION OF THE EMBODIMENTS

To gain a better understanding of the purposes and advantages of the invention, the specific implementations of the invention are expounded below in conjunction with the accompanying drawings.

Figure 1:
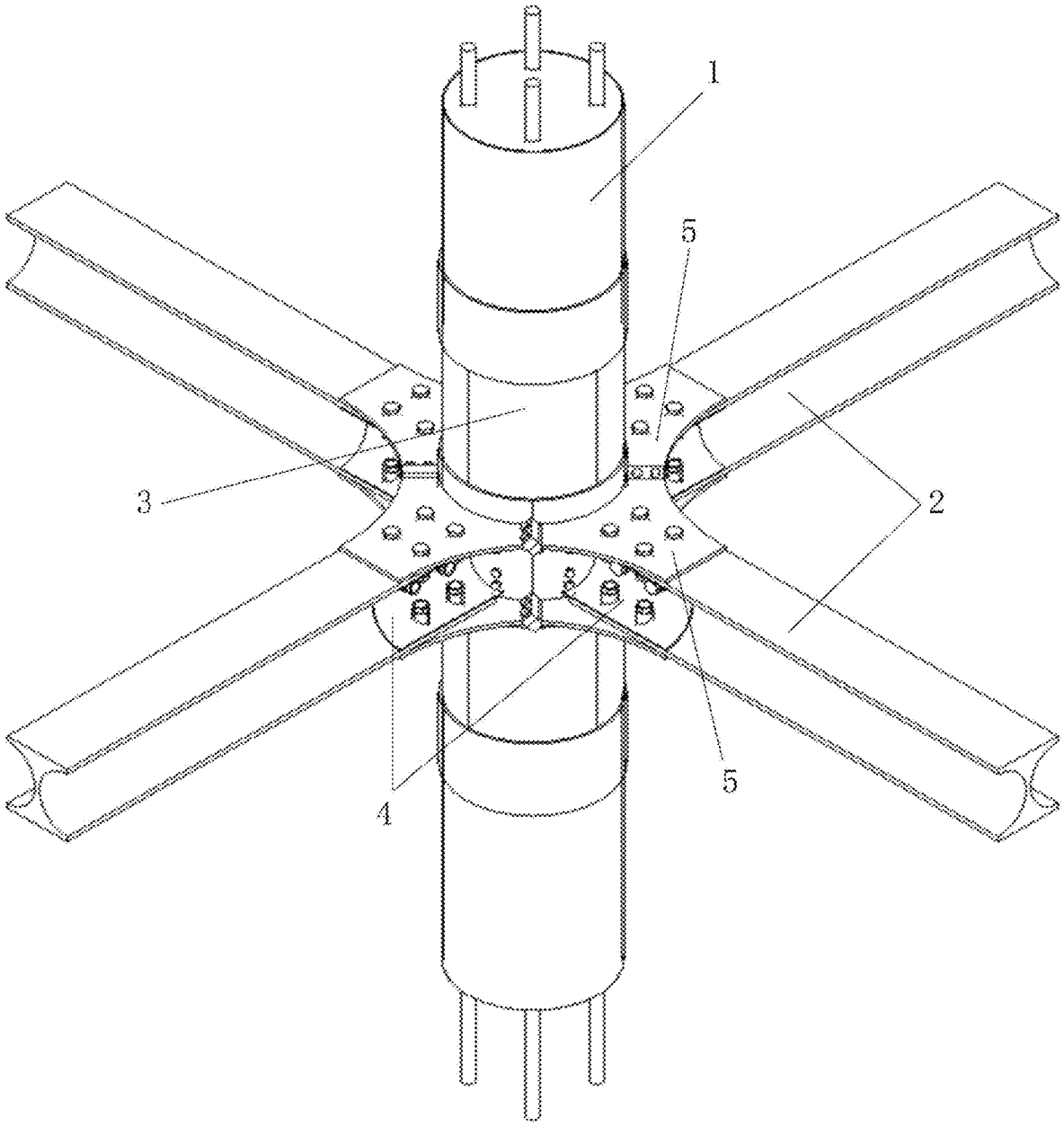
FIG. 1 is an overall structural view of a steel-wood composite joint in Embodiment 1 of the invention.
Figure 2:
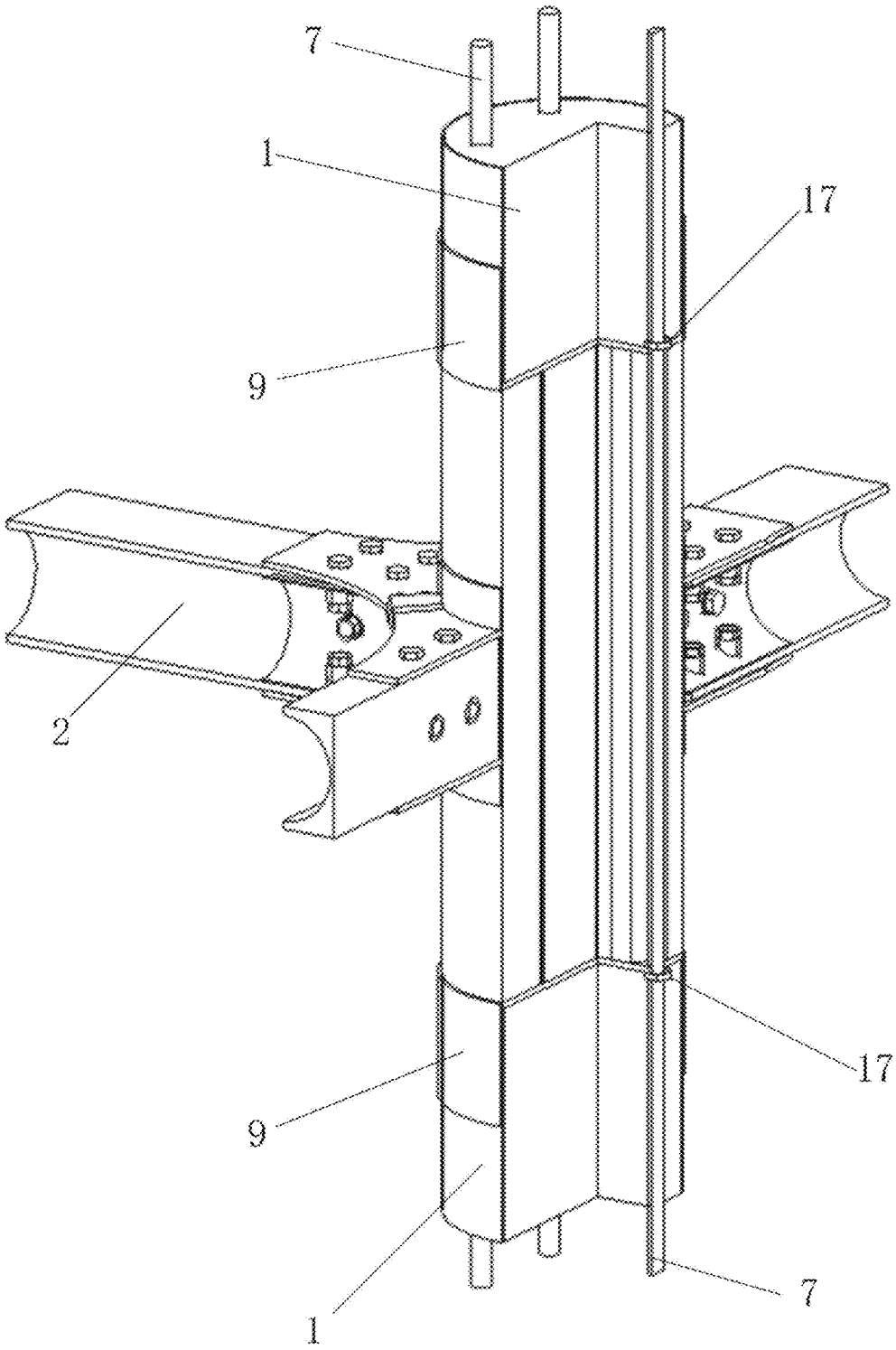
FIG. 2 is a perspective sectional view of the steel-wood composite joint in Embodiment 1 of the invention.
Figure 3:
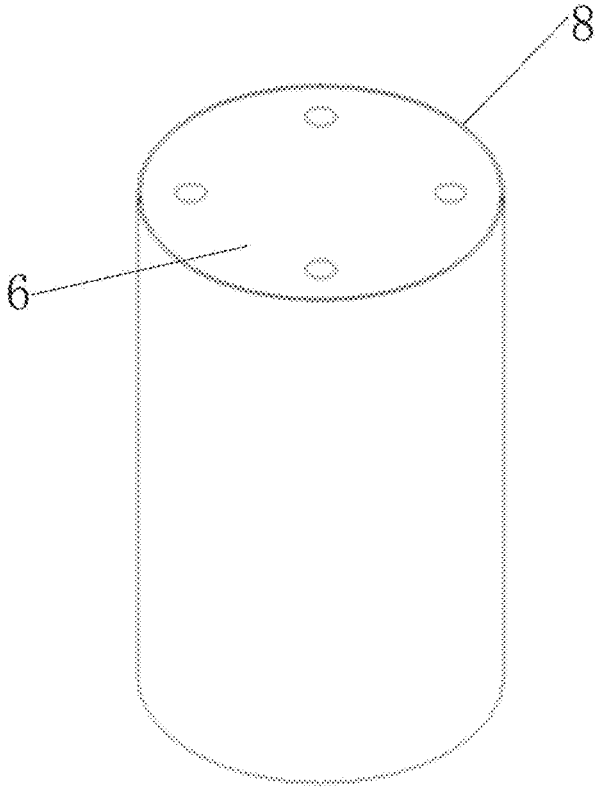
FIG. 3 is a structural view of an FRP cylindrical wood column in Embodiment 1 of the invention.
Figure 4:
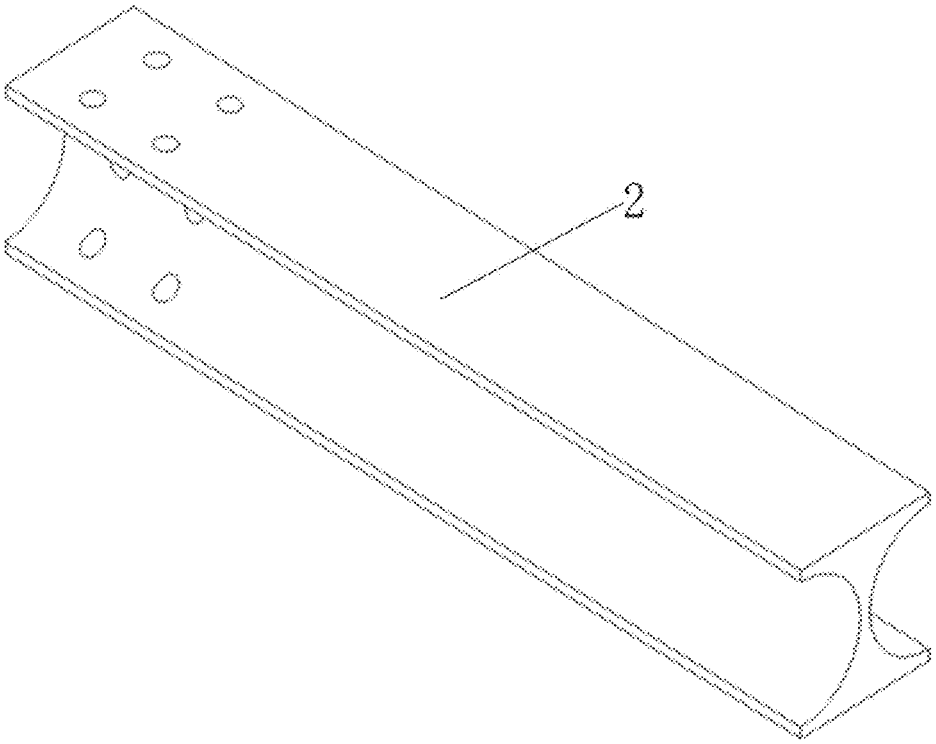
FIG. 4 is a structural view of an X-shaped wood beam in Embodiment 1 of the invention.
Figure 5:
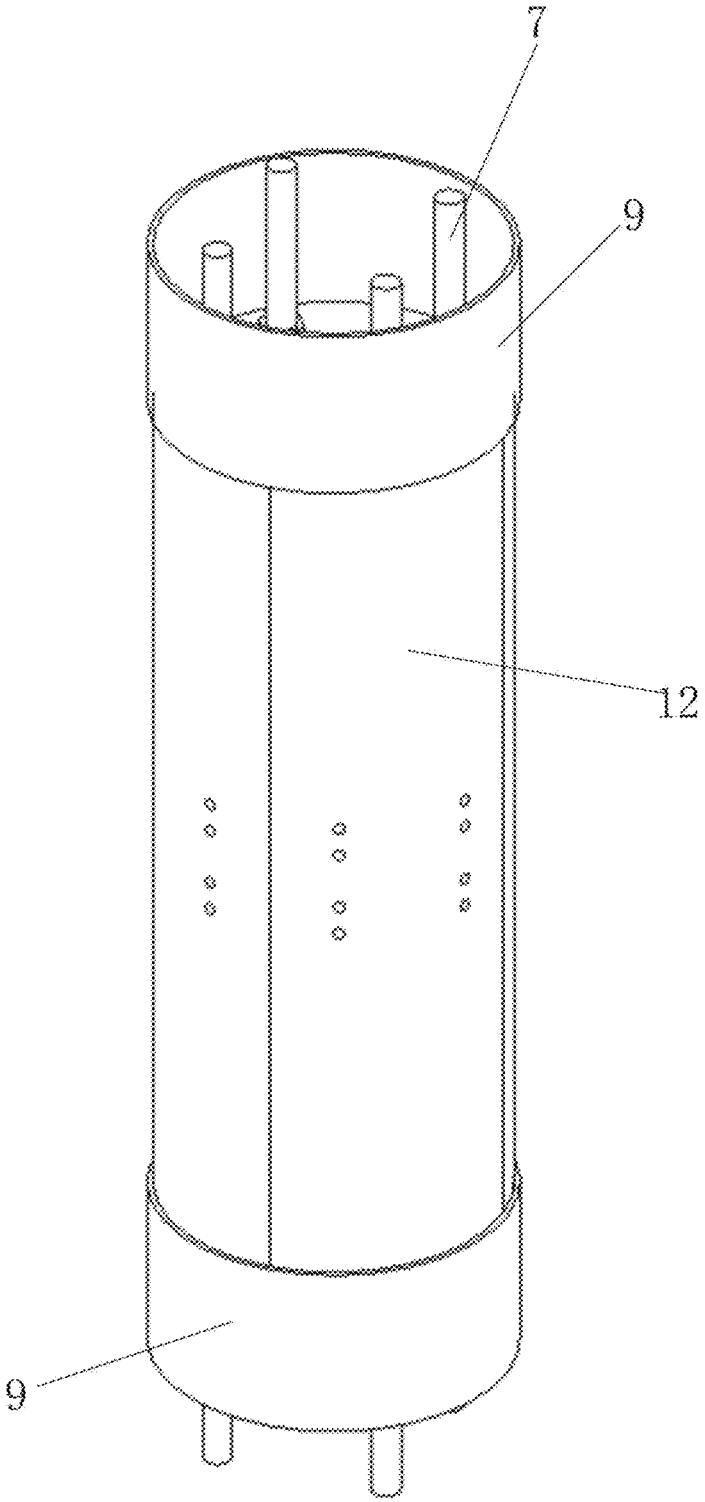
FIG. 5 is a structural view of a key connecting component in Embodiment 1 of the invention.
Figure 6:
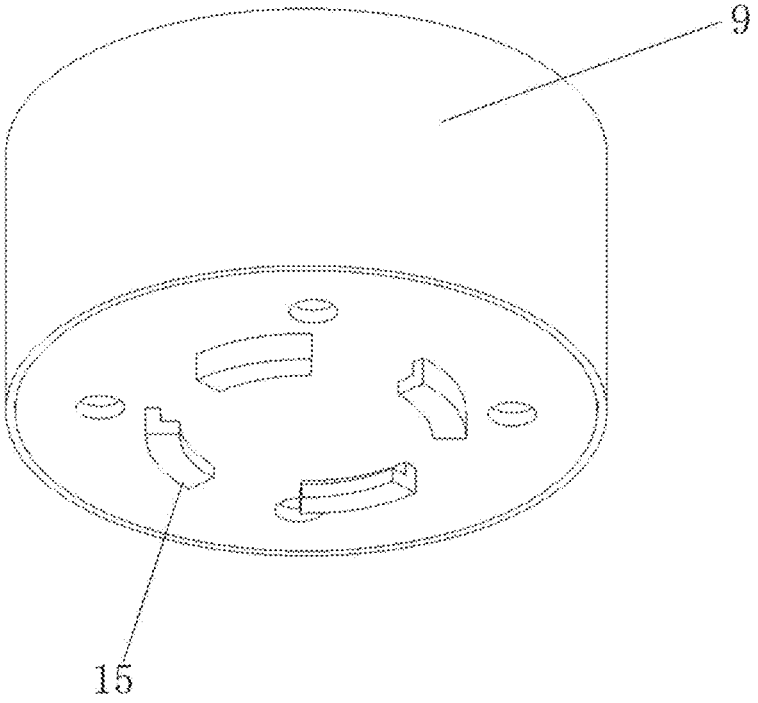
FIG. 6 is a structural view of a cylindrical steel sleeve plate in Embodiment 1 of the invention.

Embodiment 1: a cylindrical sleeve-type steel-wood composite joint, as shown in FIG. 1 and FIG. 2, comprises FRP cylindrical wood columns 1, X-shaped wood beams 3, a key connecting component 3, arc connecting pieces 4 and splicing outer ring plates 5, wherein the adjacent upper and lower FRP cylindrical wood columns 1 are connected through the key connecting component 3 and are connected to the X-shaped wood beams 2 through the arc connecting pieces 4 after being connected, and finally, the whole structure is fixed through the splicing outer ring plates 5;

As shown in FIG. 3 and FIG. 4 which are respectively the structural view of the FRP cylindrical wood column 1 and the structural view of the X-shaped wood beam 2, each FRP cylindrical wood column 1 comprises a cylindrical wood column body 6 and an FRP fabric 8 arranged on the outer surface of the cylindrical wood column body 6. The FRP fabric 8 wound on the outer surface of the cylindrical wood column body 6 enhances the structural strength of cylindrical wood column body 6. Multiple steel bar holes are uniformly formed in the cylindrical wood column body 6 in the lengthwise direction, and the number of the steel bar holes is four in this embodiment. Penetrative steel bars 7 are inserted into the steel bar holes, and glue is inject into the steel bars holes to integrate the penetrative steel bars 7 into a whole, wherein the diameter of the steel bar holes is 4-8 mm greater than that of the penetrative steel bars 7, and the penetrative steel bars 7 are ribbed steel bars. The X-shaped wood beams 2 are finished pure wood beams, and bolt holes corresponding to the arc connecting pieces 4 and the splicing outer ring plates 5 are formed in the ends of the X-shaped wood beams 2.

As shown in FIG. 5 to FIG. 11 which are structural views of the key connecting component, the key connecting component 3 specifically comprises cylindrical steel sleeve plates 9, a connecting sleeve 10, a cylindrical solid wood 11 and filling wood blocks 12, wherein the cylindrical solid wood 11 is arranged in the connecting sleeve 10, the connecting sleeve 10 is made of steel, arc splicing heads 14 are arranged at two ends of the connecting sleeve 10, connecting slots 15 matched with the arc splicing heads 14 are formed in the cylindrical steel sleeve plates 9, the arc splicing heads 14 are clamped in the connecting slots 15 to connect the cylindrical steel sleeve plates 9 and the connecting sleeve 10, the cylindrical steel sleeve plates 9 are arranged at upper and lower ends of the connecting sleeve 10, the inner diameter of the cylindrical steel sleeve plates 9 is equal to the outer diameter of the FRP cylindrical wood columns 1, and the filling wood blocks 12 encircle the connecting sleeve 10, are arranged between the upper and lower cylindrical steel sleeve plates 9 and are fixed with glue; corresponding wood screw holes 16 are formed in the filling wood blocks 12, and wood screws penetrate through the arc connecting pieces 4 and the wood screw holes 16 to fix the arc connecting pieces 4 on the key connecting component 3; steel bar holes matched with the penetrative steel bars 7 are formed in the cylindrical steel sleeve plates 9, and straight slots 13 matched with the penetrative steel bars 7 and notches matched with the arc splicing heads 14 are formed in the filling wood blocks 12; and four penetrative steel bars 7 penetrate through the corresponding steel bar holes in the cylindrical steel sleeve plates 9 to integrally connect the upper and lower FRP cylindrical wood columns 1 in an axial direction, the penetrative steel bars 7 are tensioned with split bolts 17 on the corresponding sides of the cylindrical steel sleeve plates 9, and a pre-stressing force is applied to enhance the integrity and improve the overall performance of the key connecting component.

Figure 7:
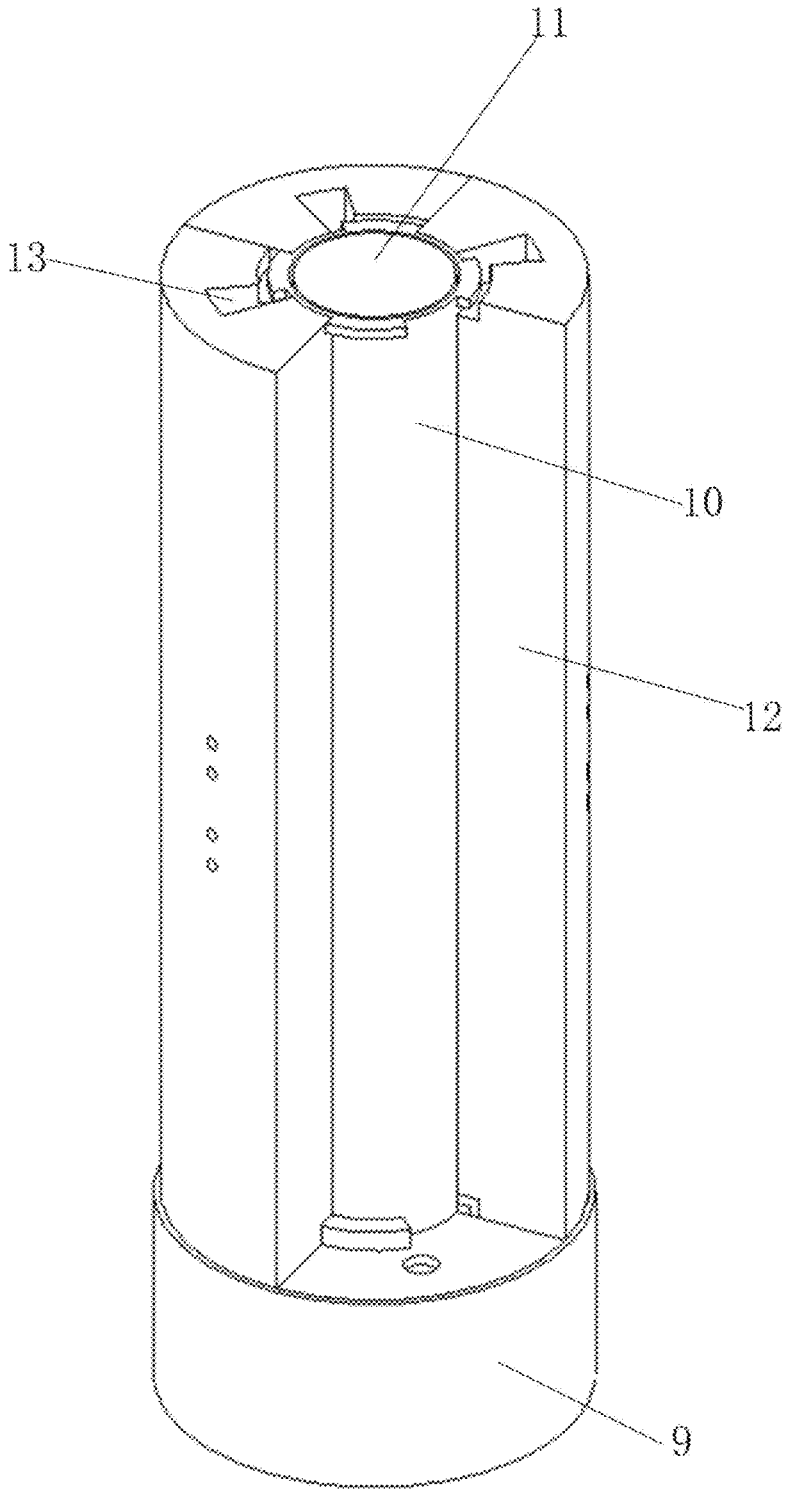
FIG. 7 is a connection diagram of cylindrical steel sleeve plates, filling wood blocks and a connecting sleeve in Embodiment 1 of the invention.
Figure 8:
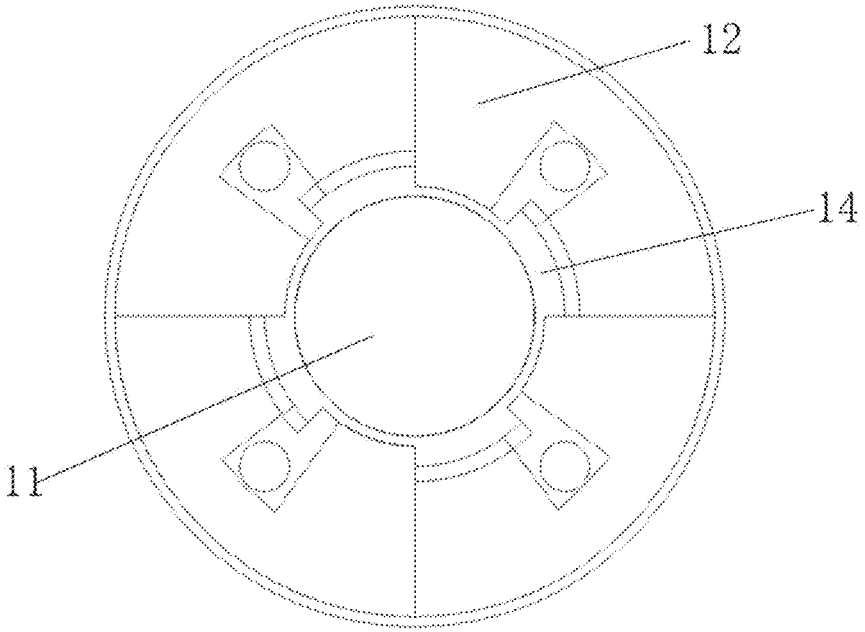
FIG. 8 is a top view of FIG. 7.
Figure 9:
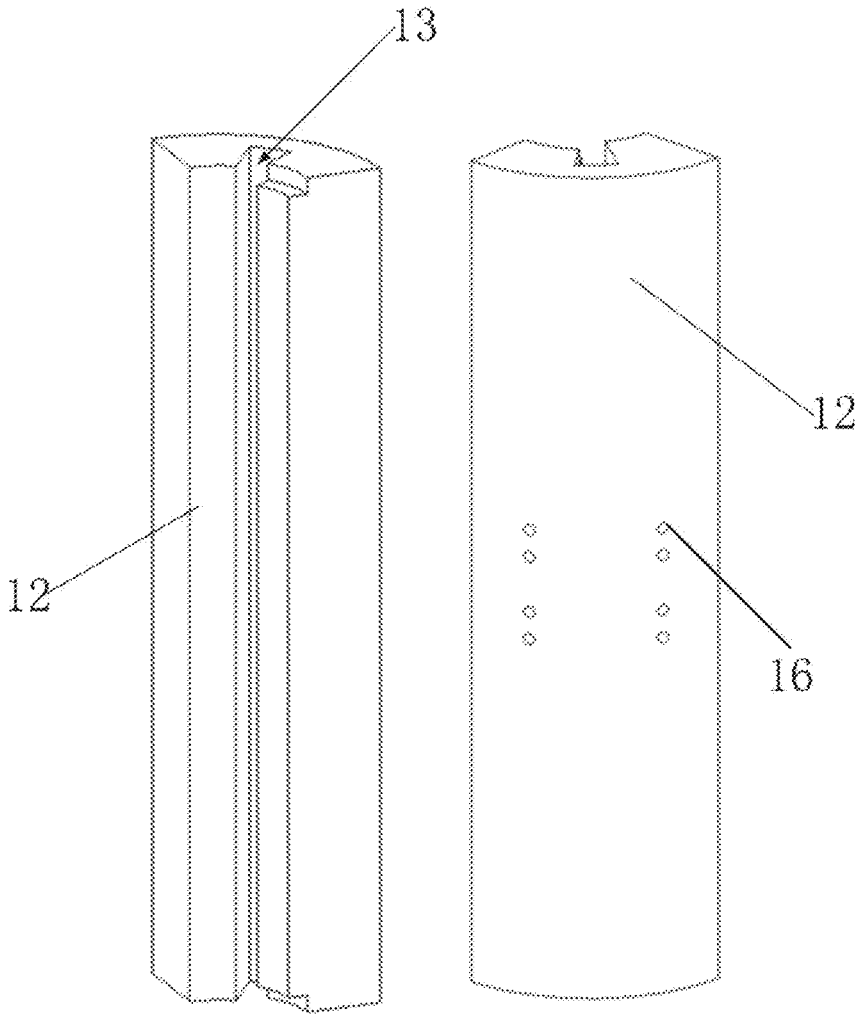
FIG. 9 is a structural view of the filling wood block in FIG. 7.
Figure 10:
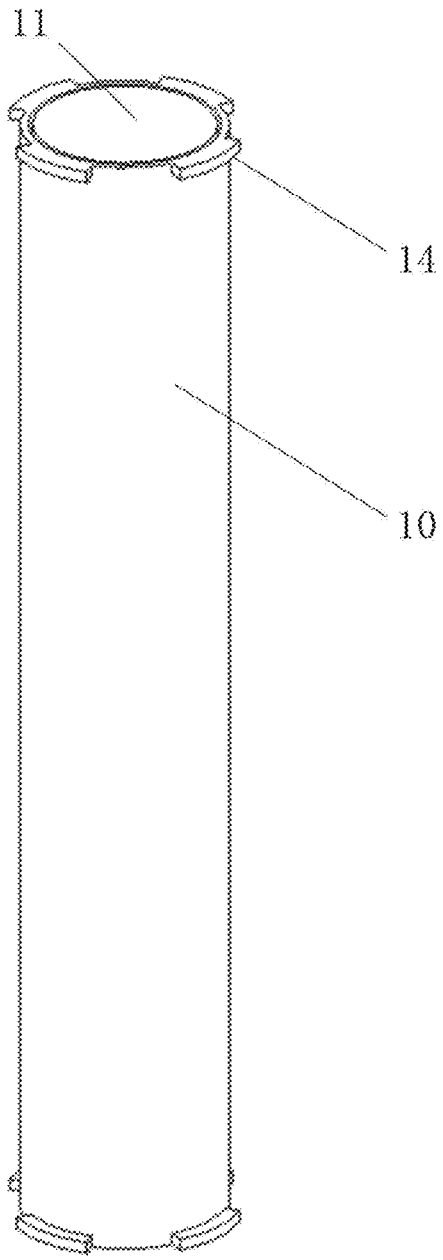
FIG. 10 is a structural view of the cylindrical steel sleeve plates and a cylindrical solid wood in FIG. 7.
Figure 11:
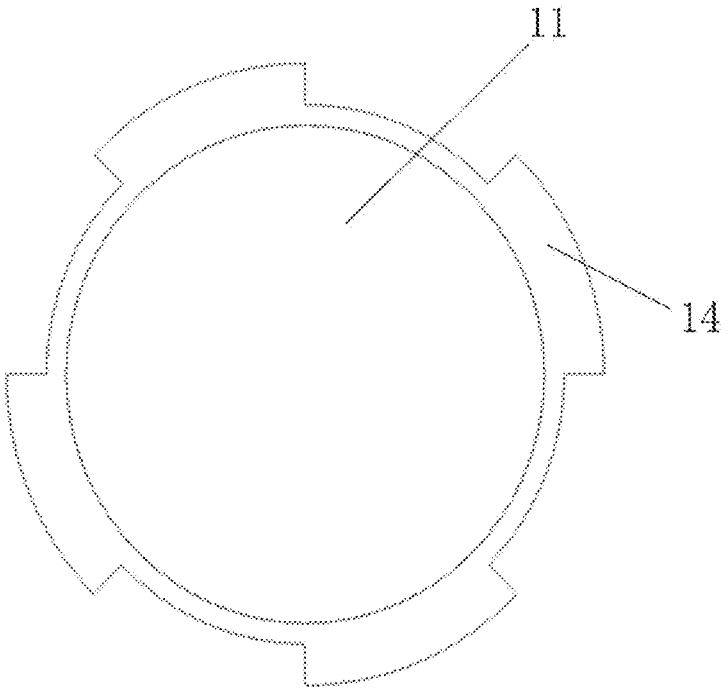
FIG. 11 is a top view of FIG. 10.
Figure 12:
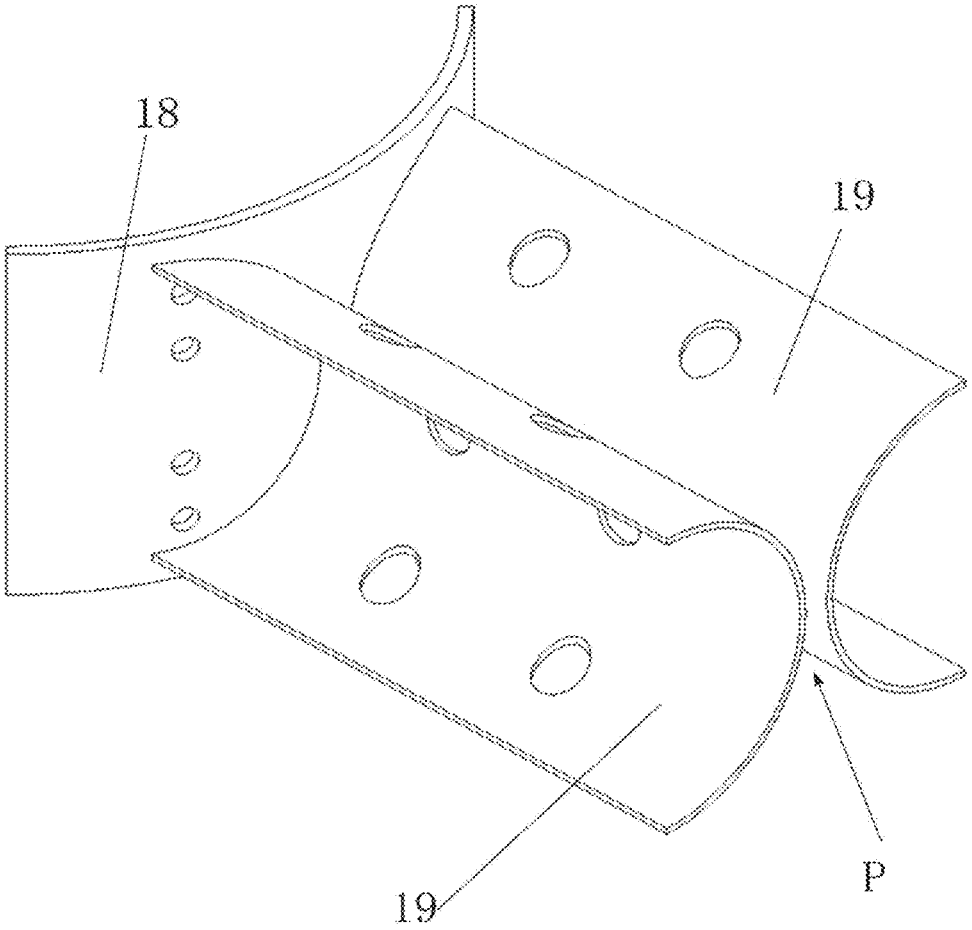
FIG. 12 is a structural view of an arc connecting piece in Embodiment 1 of the invention.
Figure 13:
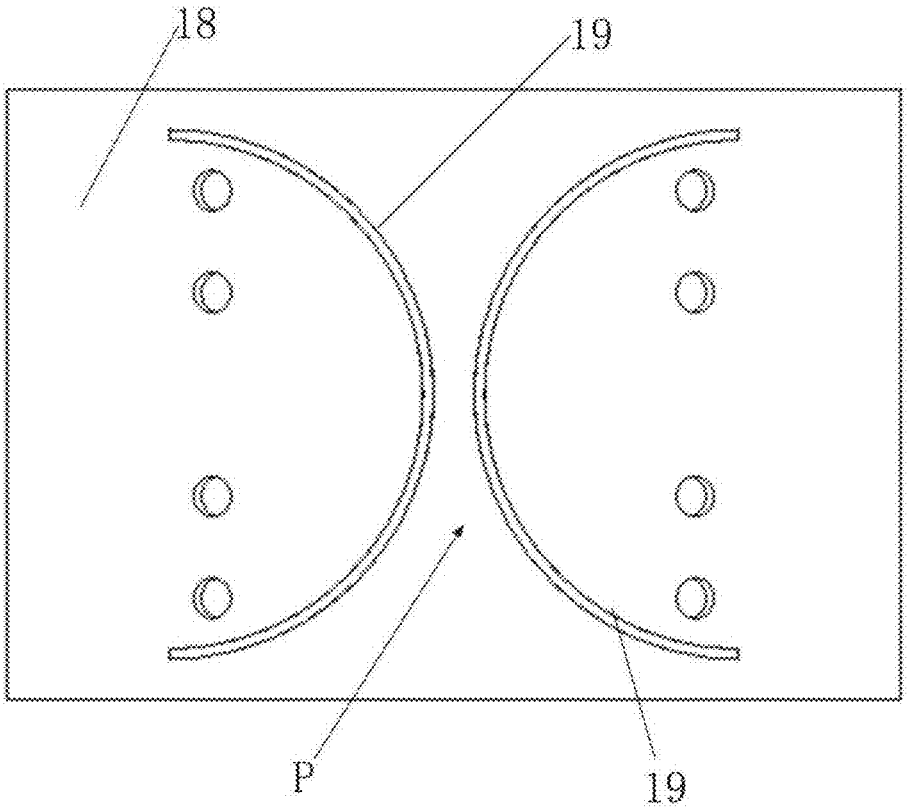
FIG. 13 is a side view of FIG. 12.

As shown in FIG. 12 and FIG. 13 which are structural views of the arc connecting pieces 4, each arc connecting piece 4 comprises a perforated arc base plate 18 and two perforated arc steel plates 19, wherein the two perforated arc steel plates 19 are perpendicularly arranged on the perforated arc base plate 18 backing onto each other, and a space formed between the two perforated arc steel plates 19 fits the X-shaped wood beams 2 in shape. The arc connecting pieces 4 are machined in factory by welding. As shown in FIG. 7, four arc connecting pieces 4 are spliced to form a circle and are fixed on the filling wood blocks 12 through wood screws and the perforated arc base plates 18, and the perforated arc steel plates 19 are used to tighten the X-shaped wood beams. Eight screw holes are formed in each perforated arc base plate 18 and correspond to four wood screw holes 16 formed in each side of each filling wood block of the key connecting component 3, the wood screws penetrate through the perforated arc base plates 18 to be screwed into the wood screw holes, and as shown in FIG. 8, each arc connecting piece 4 is fixed on two adjacent filling wood blocks 12; the distance between the two perforated arc steel plates 19 is slightly greater than the thickness of webs of the X-shaped wood beams 2, four vertical bolt holes and two horizontal bolt holes are formed in each perforated arc steel plate 19. The webs of the X-shaped wood beams 2 are inserted between the perforated arc steel plates 19. Horizontal bolts penetrate through one arc steel plates 19, the webs of the X-shaped wood beams 2 and the other arc steel plates and are then tightened with nuts, and vertical bolts penetrate through the splicing outer ring plates, flanges of the X-shaped wood beams and the arc steel plates and are then tightened with nuts.

Each splicing outer ring plate 5 consists of four steel splicing components, and the shape of the splicing outer ring plate 5 is shown in FIG. 8. The adjacent splicing outer ring plates 5 are connected through connecting clamps 20, a 45° angle is formed between each connecting clamp and the horizontal direction to ensure that force is still transferred along the centroid line, and the splicing outer ring plates are integrally connected through bolts; and after being connected, the splicing outer ring plates externally hoop a middle part of the key connecting component 3 to clamp the filling wood blocks 12 and are integrally connected to the arc connecting pieces 4 and the X-shaped wood beams 2 through bolts to transfer internal force of the beams.

Figure 14:
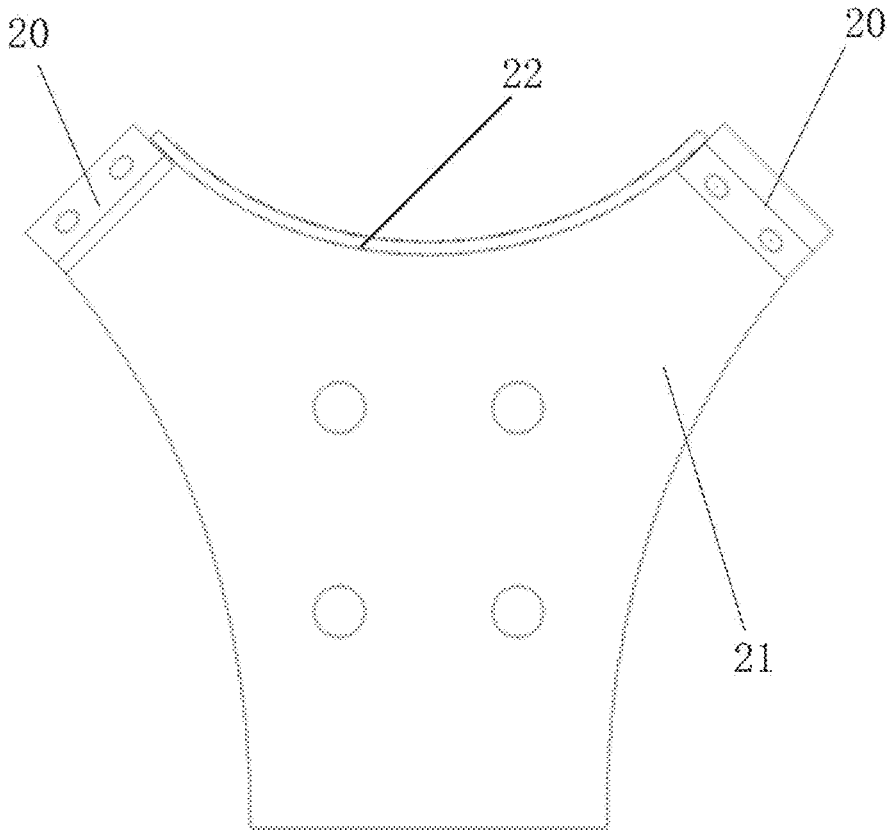
FIG. 14 is a top view of a splicing outer ring plate in the embodiment of the invention.
Figure 15:
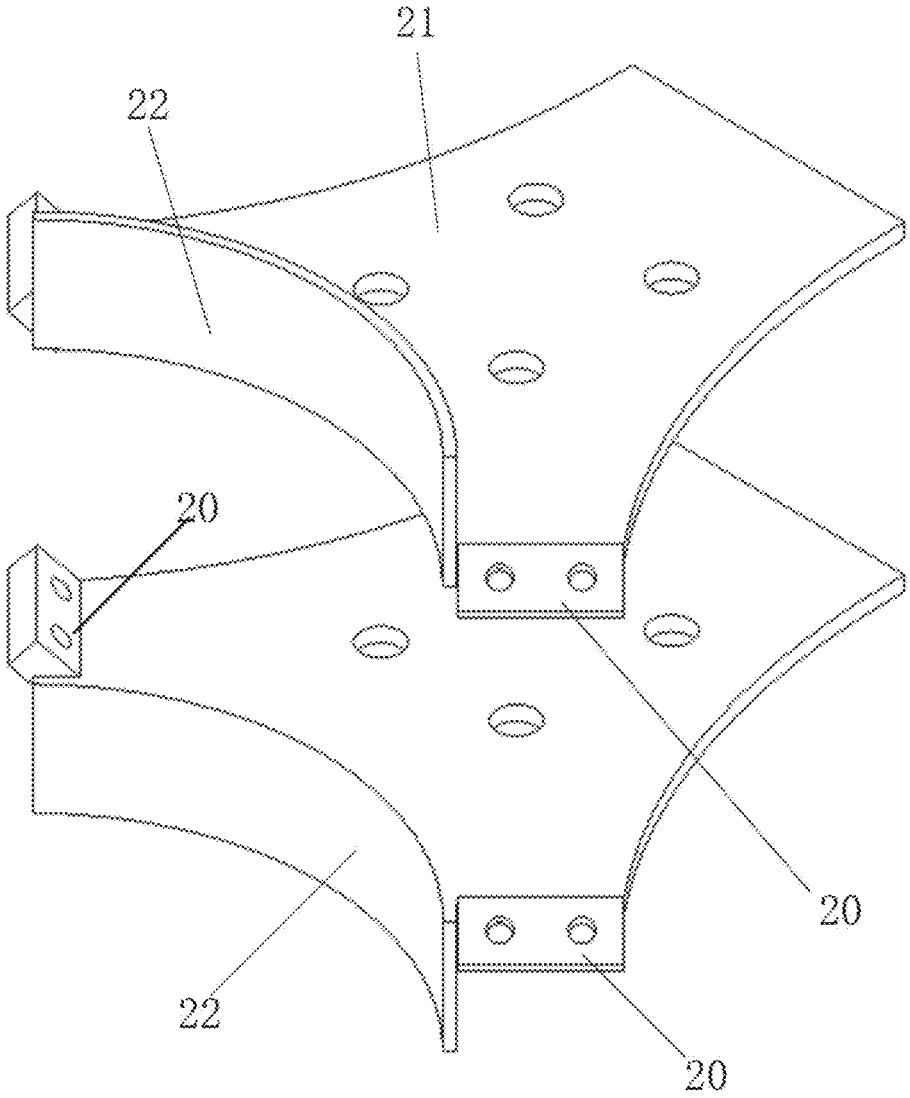
FIG. 15 is a perspective view of the splicing outer ring plate in Embodiment 1 of the invention.
Figure 16:
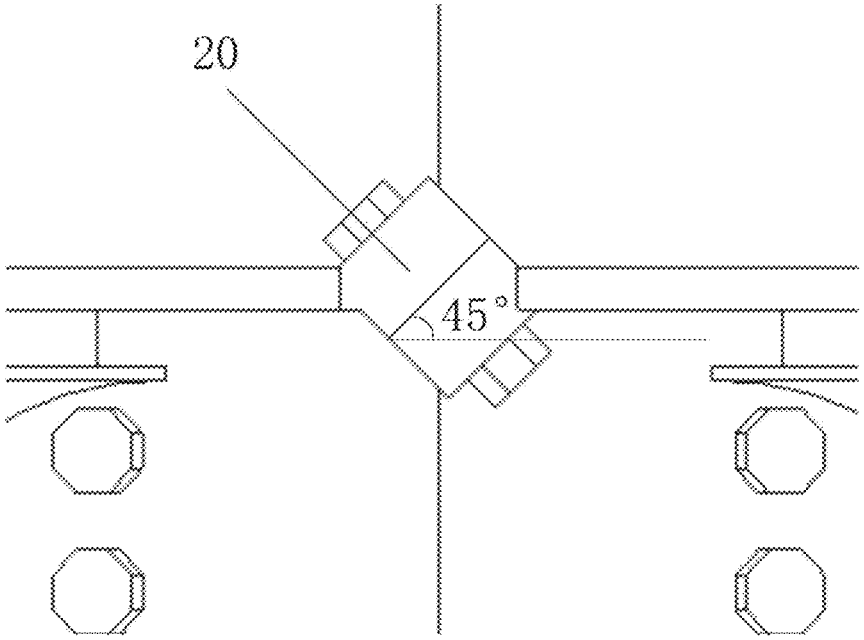
FIG. 16 is a collaboration diagram of connecting clamps in FIG. 14.

As shown in FIG. 14, each splicing outer ring plate 5 comprises a base plate 21 and an arc hoop 22 arranged on one side of the base plate 21, wherein bolt holes are formed in the surface of the base plate 21, and connecting clamps 20 are also arranged on the base plate 21. The adjacent splicing outer ring plates 5 are connected through the connecting clamps 20; and after being connected, the adjacent splicing outer ring plates 5 externally hoop a middle part of the key connecting component 3 to clamp the filling wood blocks 12 and are integrally connected to the arc connecting pieces 4 and the X-shaped wood beams 2 through bolts to transfer internal force of the beams.

According to the joint structure in this embodiment, the solid-wood connecting sleeve is connected to the cylindrical steel sleeve plates through slots in the core connection region, the filling wood blocks are filled in the connection region for glue connection, and a pre-stressing force is applied to the penetrative steel bars by means of the split bolts to enhance the combination to form an integrity; fully-prefabricated construction can be realized, the construction speed is high, and the structural integrity is good; the pre-stressing force can effectively improve the anti-seismic capacity of the structure; the design of the connecting sleeve can effectively guarantee the vertical bearing capacity of the joint; and through the ingenious design of the arc connecting pieces and the splicing outer ring plates, the joint can be applied to wood structures with extremely high requirements for the vertical bearing capacity and strength.

Figure 17:
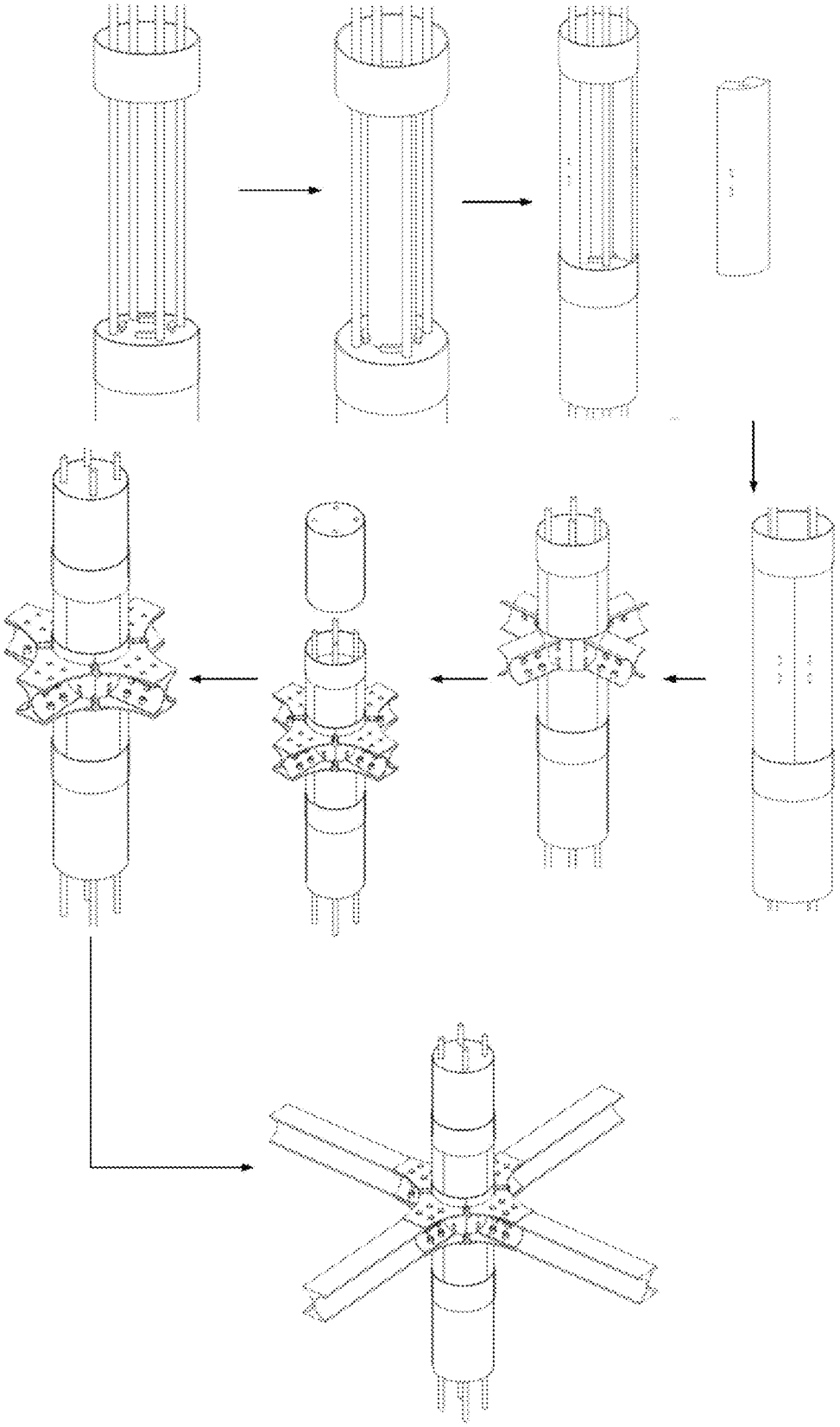
FIG. 17 is a schematic diagram of the assembly process of the joint in Embodiment 1 of the invention.

Embodiment 2: on the basis of the cylindrical sleeve-type steel-wood composite joint provided by Embodiment 1, this embodiment provides an assembly method of the cylindrical sleeve-type steel-wood composite joint. As shown in FIG. 17, the assembly method comprises the following steps which can be slightly modified as the case may be when specifically implemented:

Step 1: the cylindrical steel sleeve plates 9 are disposed around the FRP cylindrical wood columns 1 injected with glue, the split bolts are arranged on the penetrative steel bars, and the arc splicing heads of the connecting sleeve 10, internally provided with the cylindrical solid wood 11, are rotated by 45° to be screwed into the connecting slots in corresponding sides of the cylindrical steel sleeve plates 9;

Step 2: the connecting sleeve 10 is fixed between the cylindrical steel sleeve plates 9, and four filling wood blocks are inserted and bonded into a whole with glue;

Step 3: the arc connecting pieces 4 are disposed at the tails of middle parts two adjacent filling wood blocks of the key connecting component 3, four wood screws penetrate through each steel plate on each side and are screwed into the filling wood blocks to fix each arc connecting piece on two adjacent filling wood blocks, the four arc connecting pieces 4 are assembled at corresponding positions of the integrally bonded filling wood blocks 12 with the wood screws to form an untight sleeve, and the four filling wood blocks are integrated;

Step 4: the four components of each splicing outer ring plate 5 are assembled close to one arc connecting piece and are connected into a hoop through bolts to clamp the filling wood blocks; the splicing outer ring plates 5 are assembled at upper and lower ends of the arc connecting pieces 4; and after the splicing outer ring plates 5 are assembled, the FRPB fabric is wound on the upper side of the upper cylindrical steel sleeve plate or between the splicing outer ring plates and the cylindrical steel sleeve plates;

Step 5: the split bolts 17 on the penetrative steel bars 7 are tightened, and an appropriate pre-stressing force is applied to realize tight connection of the key connecting component 3 to enhance the integrity of the key connecting component;

Step 6: the FRP cylindrical wood columns 1 are inserted into the sleeve on corresponding sides of the cylindrical steel sleeve plates 9, and glue are injected into the steel bar holes to complete installation of the vertical columns and the key connecting component; and Step 7: one end of each X-shaped wood beam 2 is inserted between the two arc plates of each arc connecting piece (4), and high-strength bolts are inserted into two horizontal bolt holes formed in each arc plate and a web of each X-shaped wood beam to realize connection;

Bolts are vertically inserted into two bolt holes correspondingly formed in the splicing outer ring plates, flanges of the X-shaped wood beams and the arc plates of the arc connecting pieces in the vertical direction and are tightened with special spacers and nuts; and The arc connecting pieces 4, the X-shaped wood beams 2 and the splicing outer ring plates 5 are integrally connected through bolts to complete installation of the beams in the horizontal direction, so that assembly of the whole cylindrical sleeve-type steel-wood composite joint is finished.

The above embodiments are merely preferred ones of the invention, and are not intended to limit the invention in any forms. Any skilled in the art may apply equivalent embodiments obtained by modifying or transforming the technical contents disclosed above to other fields. Any simple amendments, equivalent modifications or transformations made to the above embodiments on the basis of the technical essence of the invention should also fall within the protection scope of the technical solutions of the invention.

What is claimed is:

1. A cylindrical sleeve-type steel-wood composite joint, comprising fiberglass reinforced panel (FRP) cylindrical wood columns and X-shaped wood beams, and further comprising a key connecting component, arc connecting pieces and splicing outer ring plates, wherein the FRP cylindrical wood columns are connected through the key connecting component, the X-shaped wood beams are connected to the key connecting component through the arc connecting pieces, the splicing outer ring plates are arranged on upper and lower sides of the arc connecting pieces, and the splicing outer ring plates are fixed with bolts to realize combination and connection for assembling the cylindrical sleeve-type steel-wood composite joint;

the key connecting component comprises cylindrical steel sleeve plates, a connecting sleeve, a cylindrical solid wood and filling wood blocks, wherein the cylindrical steel sleeve plates are arranged at upper and lower ends of the connecting sleeve, the cylindrical solid wood is arranged in the connecting sleeve, an inner diameter of the cylindrical steel sleeve plates is equal to an outer diameter of the FRP cylindrical wood columns, and the filling wood blocks encircle the connecting sleeve, are arranged between the upper and lower cylindrical steel sleeve plates and are fixed with glue; steel bar holes allowing penetrative steel bars to be inserted therein are formed in the cylindrical steel sleeve plates, corresponding steel bar holes are formed in the FRP cylindrical wood columns, and the penetrative steel bars penetrate through the corresponding steel bar holes in the cylindrical steel sleeve plates to integrally connect the FRP cylindrical wood columns in an axial direction;

each arc connecting piece comprises a perforated arc base plate and two perforated arc steel plates, wherein the two perforated arc steel plates are arranged on the perforated arc base plate backing onto each other, and a space formed between the two perforated arc steel plates fits the X-shaped wood beams in shape; the arc connecting pieces are arranged around an outer circumference of the key connecting component, and each perforated arc base plate is fixed between two adjacent filling wood blocks with wood screws; and each splicing outer ring plate comprises a base plate and an arc hoop arranged on one side of the base plate, wherein bolt holes are formed in a surface of the base plate, and connecting clamps are arranged on the base plate; the adjacent splicing outer ring plates are connected through the connecting clamps; and after being connected, the adjacent splicing outer ring plates externally hoop a middle part of the key connecting component to clamp the filling wood blocks and are integrally connected to the arc connecting pieces and the X-shaped wood beams through bolts to transfer an internal force of the X-shaped wood beams.

2. The cylindrical sleeve-type steel-wood composite joint according to claim 1, wherein each FRP cylindrical wood column comprises a cylindrical wood column body and an FRP fabric arranged on an outer surface of the cylindrical wood column body.

3. The cylindrical sleeve-type steel-wood composite joint according to claim 1, wherein arc splicing heads are arranged at upper and lower ends of the connecting sleeve, and connecting slots matched with the arc splicing heads are arranged on the cylindrical steel sleeve plates.

4. The cylindrical sleeve-type steel-wood composite joint according to claim 3, wherein straight slots matched with the penetrative steel bars and notches matched with the arc splicing heads are formed in the filling wood blocks.

5. The cylindrical sleeve-type steel-wood composite joint according to claim 1, wherein a 45° angle is formed between each connecting clamp and a plane where the base plate is located.

6. The cylindrical sleeve-type steel-wood composite joint according to claim 1, wherein split bolts for tensioning the penetrative steel bars are further arranged on the cylindrical steel sleeve plates.

7. An assembly method of the cylindrical sleeve-type steel-wood composite joint according to claim 1, comprising the following steps:

disposing the cylindrical steel sleeve plates around the FRP cylindrical wood columns injected with glue, and screwing arc splicing heads of the connecting sleeve, internally provided with the cylindrical solid wood, into connecting slots in corresponding sides of the cylindrical steel sleeve plates, wherein arc splicing heads are arranged at upper and lower ends of the connecting sleeve, and connecting slots matched with the arc splicing heads are arranged on the cylindrical steel sleeve plates;

fixing the connecting sleeve between the cylindrical steel sleeve plates, inserting four filling wood blocks, and bonding the filling wood blocks into a whole with glue;

assembling four arc connecting pieces at corresponding positions of the filling wood blocks with wood screws, fixing each arc connecting piece on two adjacent filling wood blocks, and connecting the four arc connecting pieces to form a sleeve around the key connecting component;

assembling the splicing outer ring plates close to the arc connecting pieces, and connecting the splicing outer ring plates into a hoop to clamp the filling wood blocks;

tightening split bolts on the penetrive steel bars, and applying an appropriate pre-stressing force to realize tight connection of the key connecting component to enhance the integrity of the key connecting component, wherein split bolts for tensioning the penetrative steel bars are further arranged on the cylindrical steel sleeve plates;

inserting the FRP cylindrical wood columns into a sleeve on corresponding sides of the cylindrical steel sleeve plates, and injecting glue into the steel bar holes to complete installation of the FRP cylindrical wood columns in a vertical direction and the key connecting component; and inserting one end of each X-shaped wood beam between the two perforated arc steel plates of each arc connecting piece, inserting bolts for connection, and connecting the arc connecting pieces, the X-shaped wood beams and the splicing outer ring plates into a whole through the bolts to complete installation of the X-shaped wood beams in a horizontal direction, so that assembly of the cylindrical sleeve-type steel-wood composite joint is finished.

8. The assembly method according to claim 7, wherein each FRP cylindrical wood column comprises a cylindrical wood column body and an FRP fabric arranged on an outer surface of the cylindrical wood column body.

9. The assembly method according to claim 7, wherein the arc splicing heads are arranged at upper and lower ends of the connecting sleeve, and the connecting slots matched with the arc splicing heads are arranged on the cylindrical steel sleeve plates.

10. The assembly method according to claim 9, wherein straight slots matched with the penetrative steel bars and notches matched with the arc splicing heads are formed in the filling wood blocks.

11. The assembly method according to claim 7, wherein a 45° angle is formed between each connecting clamp and a plane where the base plate is located.

12. The assembly method according to claim 7, wherein the split bolts for tensioning the penetrative steel bars are further arranged on the cylindrical steel sleeve plates.

* * * * *